US007067040B2

(12) United States Patent
Lepomäki et al.

(10) Patent No.: US 7,067,040 B2
(45) Date of Patent: Jun. 27, 2006

(54) HEADBOX OF PAPER MACHINE OR SUCH

(75) Inventors: Hannu Lepomäki, Laukaa (FI); Maarit Tukiainen, Säynätsalo (FI); Jyrki Huovila, Muurame (FI)

(73) Assignee: Metso Paper, Inc., Helsinki (FI)

( * ) Notice: Subject to any disclaimer, the term of this patent is extended or adjusted under 35 U.S.C. 154(b) by 358 days.

(21) Appl. No.: 10/311,007

(22) PCT Filed: Jun. 12, 2001

(86) PCT No.: PCT/FI01/00553

§ 371 (c)(1),
(2), (4) Date: Apr. 28, 2003

(87) PCT Pub. No.: WO01/96657

PCT Pub. Date: Dec. 20, 2001

(65) Prior Publication Data

US 2003/0159792 A1 Aug. 28, 2003

(30) Foreign Application Priority Data

Jun. 13, 2000 (FI) ..... 2000 1404

(51) Int. Cl.
*D21F 1/00* (2006.01)

(52) U.S. Cl. ..... 162/216; 162/259; 162/343; 162/336

(58) Field of Classification Search ..... 162/216, 162/259, 343, 336
See application file for complete search history.

(56) References Cited

U.S. PATENT DOCUMENTS 4,376,014 A 3/1983 Bergstrom
5,183,537 A 2/1993 Hergert et al.
5,746,889 A * 5/1998 Huovila et al. ..... 162/216
2003/0155093 A1 8/2003 Lepomaki et al.

FOREIGN PATENT DOCUMENTS

FI 69330 9/1985
FI 870705 10/1990
WO 01/21885 A1 3/2001
WO 01/96657 A1 12/2001

OTHER PUBLICATIONS

International Preliminary Examination Report issued in International Patent Application No. PCT/FI01/00553.
International Search Report issued in International Patent Application No. PCT/FI01/00553.
Search report issued in Finnish Priority Application No. 20001404.
Preliminary Amendment and Substitute Specification from U.S. App. No.: 10/088,714.

* cited by examiner

*Primary Examiner*—Mark Halpern
(74) *Attorney, Agent, or Firm*—Stiennon & Stiennon

(57) ABSTRACT

A headbox (10) of a paper machine or such includes a bypass manifold ($J_1$), from which the pulp is conducted by way of pipes (11$a_{1.1}$, 11$a_{1.2}$ . . . 11$a_{2.1}$, 11$a_{2.2}$ . . . ) of pipe rows in a set of pipes (11) and an intermediate chamber (E) into a turbulence generator (12), or from the bypass manifold ($J_1$) directly into the turbulence generator and by way of the pipes (12$a_{1.1}$, 12$a_{1.2}$, . . . ; 12$a_{2.1}$, 12$a_{2.2}$ . . . ) of the turbulence generator's (12) pipe rows into a lip cone (K) and further out from the headbox on to a formation wire. The turbulence generator (12) of the headbox includes a fluidization element (14), wherein fluidization is carried out in one stage only and in which structure as little disturbance as possible is then caused to the fluidised flow.

14 Claims, 9 Drawing Sheets

HEADBOX OF PAPER MACHINE OR SUCH

CROSS REFERENCES TO RELATED APPLICATIONS

This application is a U.S. national stage application of International Application No. PCT/FI01/00553, filed Jun. 12, 2001, and claims priority on Finnish Application No. 20001404 filed Jun. 13, 2000, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention concerns a headbox of a paper machine or such.

The making of paper of a good quality and a stable production process make high demands on the headbox of the paper machine. In particular, a headbox meeting qualitative and productive requirements is expected to be able to produce a homogenous and trouble-free lip discharge.

Various applications in operation and further refinement processes make high qualitative demands on paper and board products. In practice, these demands concern the structural, physical and visual characteristics of the products. In order to achieve characteristics suitable for each individual purpose the production processes are optimised at each time for a certain working range, which sets limits usually also limiting the quantity of production. Thus, a product of the desired kind can be made only in a narrow working range of the production process.

Due to the restrictions made by the working range it is very difficult to carry out such changes in the process which aim at increasing the production and at improving the quality of the product. Significant changes usually require long-range research and technological development. Process changes desirable for an increased productivity of the manufacturing process are e.g. new techniques to do with an increased machine speed and a minimised use of water (increased web formation consistency).

In order to make paper of a good quality efforts are made to prevent various disturbances, such as vortexes and consistency streaks, from escaping from the headbox. Such disturbances may occur e.g. in connection with fluidisation (a strong geometrical change) and in the output ends of the pipes of a turbulence generator (disturbances from pipe walls, such as vortexes and consistency and speed profiles). For this reason, 1) fluidisation with small geometrical steps and
2) a low pipe-specific flow rate have typically been used in the headbox.

It follows from a low flow rate that the average residence time of the fibre pulp in the headbox after fluidisation is too long as regards avoidance of re-flocculation. Thus, the fibre pulp will not discharge from the headbox in the fluidised state required for a good formation. To improve fluidisation, lamellas have in fact been introduced for use in the headbox. These lamellas are mounted in the lip channel and they bring about more friction surface in the channel. However, the most significant fluidisation-promoting effect of the lamellas relates to their tip turbulences. Although these turbulences are advantageous for the fluidisation, they cause coherent flow structures which will weaken slowly, but which can be seen even in the produced paper. In practice, the added friction surface brought about by lamellas and the increased yield of boundary-layer turbulence are not sufficient to fluidise the flow. However, with the aid of friction surfaces in flow channels and with the aid of boundary-layer turbulence it is possible to maintain the strongly fluidised state brought about in the turbulence generator. An incomplete (cautious) fluidisation carried out in many stages leads to a more disadvantageous floc structure than fluidisation carried out in one go and based on a controlled residence time.

SUMMARY OF THE INVENTION

The headbox according to the invention is different from state-of-the-art solutions in that in the headbox according to the invention fluidisation is carried out only once in one stage in each pipeline. Thus, each pipeline includes only one fluidisation element. When the fluidisation has been carried out effectively, the flow is accelerated and the fluidisation level is maintained by using lamellas and suitable flow surfaces. By accelerating the flow the residence time of the pulp in the headbox after the fluidisation point is kept as short as possible, so that the fluidisation level remains good also as the pulp arrives at the formation wire, e.g. into the jaw between the formation wires of the jaw former. Thus, the headbox according to the invention in its turbulence generator 12 includes in each row of pipes only one fluidiser, that is, a fluidisation element, which is used for fluidisation of the pulp. Thereafter the pulp is guided in the flow direction along such flow paths, which do not include any steps or other places that would cause disturbances to the flow.

In the headbox structure according to the invention, it has been found that by increasing pipe-specific flows of the headbox's turbulence generator the paper quality is improved and the web formation consistency can be increased. This is possible by generating more turbulence in the fluidiser and thus bringing about a more complete fluidisation than with traditional headbox solutions. The harmful effects of the raised turbulence level are eliminated by limiting the scale of vortex size of the generated turbulence.

Fluidisation means that the flow characteristics of the fibre suspension are made to correspond with the characteristics of the water flow. That is, multi-phase flow behaves like a single-phase flow. Hereby the wood fibres, fillers and fines in the fibre suspension flow will behave like water. Fibre lumps, that is, fibre flocs, in the fluidisation are broken up.

Thus, in the headbox according to the invention fluidisation is carried out only once and its level is hereby higher than with a conventional headbox. The fluidisation is preferably implemented in a rotationally symmetrical pipe expansion. However, the used total pressure energy is not necessarily higher than before, because other fluidisation elements, such as steps at the ends of turbopipes and at the tips of lamellas, are minimised. The fluidisation level and thus the minimum floc size are controlled by choosing the entity formed by the fluidiser primary pipes, step expansion and vortex chamber to produce the desired loss energy. A higher fluidisation level is achieved with an increased energy supply.

BRIEF DESCRIPTION OF THE DRAWINGS

The invention will be described in the following by referring to the figures in the appended drawings and graphic presentations. The description of the inventive theory is based on the graphic presentations, and the illustrations of headbox embodiments of the invention show some advantageous embodiments of the invention, although the intention is not to restrict the invention solely to these.

DESCRIPTION OF THE PREFERRED EMBODIMENTS

Figure 1:
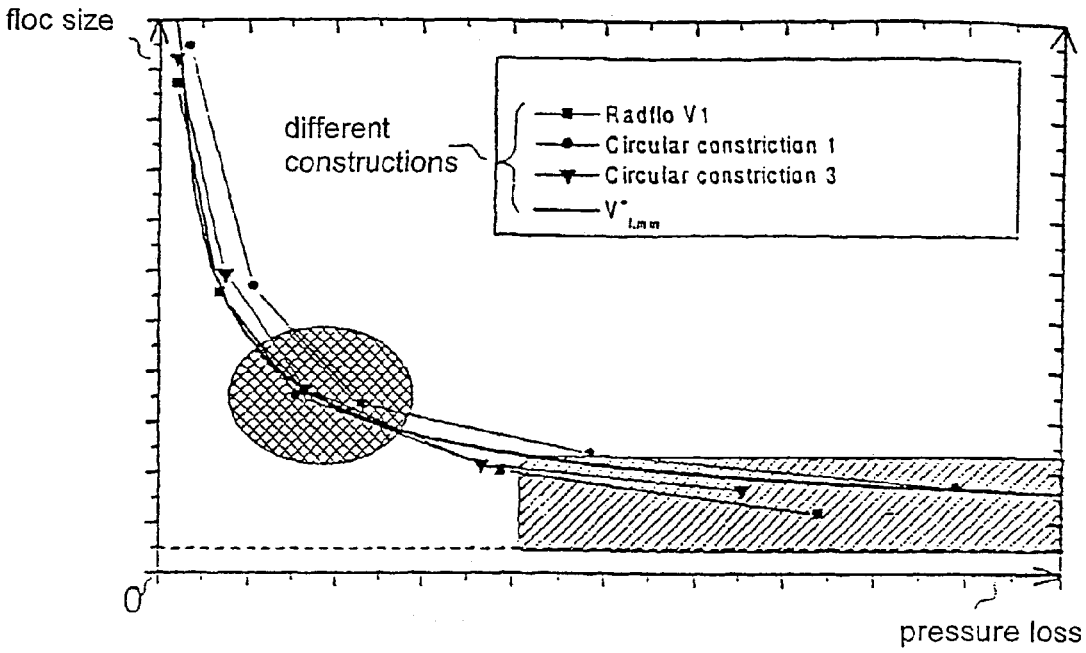
FIG. 1 is a graphic presentation showing the state-of-the-art working range (an oval) and the working range (a rectangle) according to the invention, and the presentation illustrates the fluidisation power of the headbox according to the invention as a function of the fluidiser's loss energy. The vertical coordinates show the floc size while the horizontal coordinates show the pressure loss. The descriptors indicated by various marks present different constructions.

FIG. 1 shows fluidisation (an oval) brought about by the fluidiser of a conventional traditional headbox and the working range (a rectangle) of the headbox according to the invention. The fluidisation element of the headbox according to the invention, e.g. in a tubular turbulence generator, is dimensioned so that the lower limit of its working range corresponds by and large with the optimum of the pressure loss-minimum floc size curve (slope=−1).

Since the minimum floc size is reduced logarithmically as the loss power (the flow rate) increases, almost the same fluidisation level is achieved with flow rates exceeding the dimensioning point corresponding with the above-mentioned optimum. However, due to the higher flow rate, a shorter residence time hereby results and thus a better fluidisation level is achieved in the outflow from the headbox. The maximum of the flow rate range is formed by the time needed in the lip channel for disturbance in the lags of turbopipes and lamellas to die out. In the headbox according to the invention, this maximum of the flow rate range is considerably higher than in the traditional headbox, because in connection with the fluidisation a high level of turbulence is brought about, which is kept up with the aid of a high flow rate and a small channel size.

Due to the efficient fluidiser a powerful turbulence is achieved in the headbox according to the invention. Such a step is used as fluidiser, the dimension of which is larger than the average fibre length. In this way a vortex size sufficient for breaking flocs is achieved along with an efficient supply of energy. After the fluidiser the turbulence begins dying out promptly. Although vortexes bigger than the average fibre length are needed for breaking the flocs, they will cause quick re-flocculation after the fluidisation.

Figure 2:
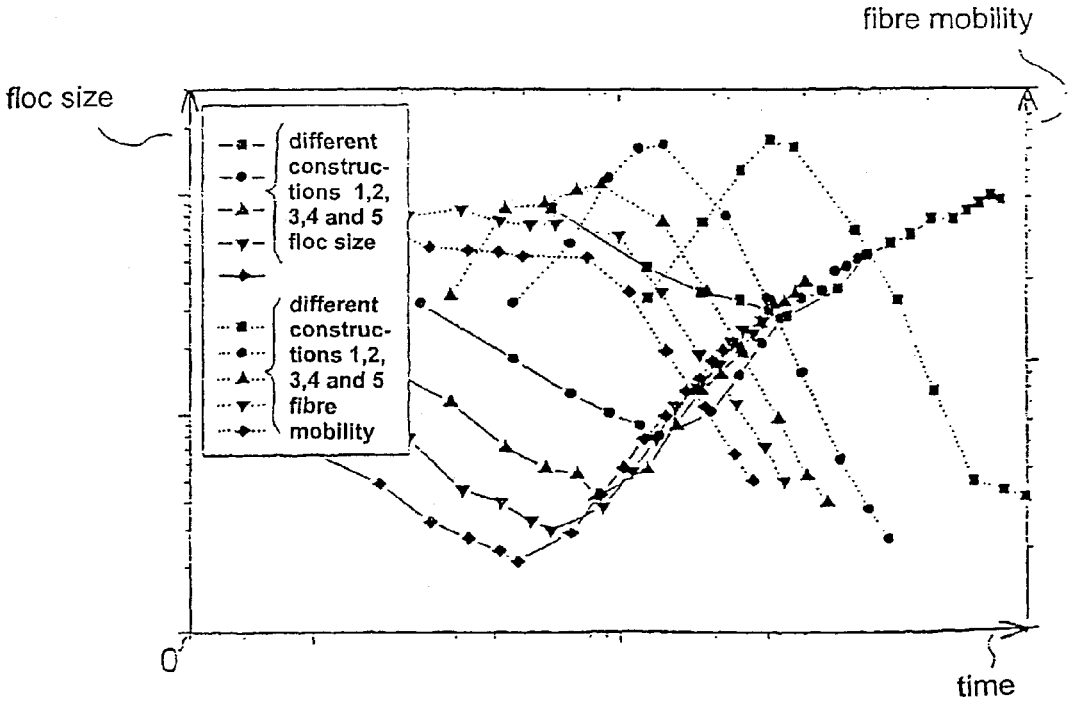
FIG. 2 shows the re-fluidisation process after the fluidiser and the related reduction in fibre mobility. The presentation is hereby read so that the floc size relating to each descriptor shown by a solid line is read from the vertical axis at the left, while the residence time is read from the horizontal coordinate. The vertical axis at the right shows fibre mobility in relation to the residence time. The descriptors indicated by dashed lines are hereby read. The descriptors illustrate different constructions and thereby different pressure losses. Identical marks relate to the same headbox construction and thus to the same pressure loss.

FIG. 2 shows the re-flocculation process after the fluidiser as well as the related decline in fibre mobility. The presentation is hereby read in such a way that the floc size relating to each descriptor indicated by a solid line can be read from the vertical axis at the left, while the residence time is read from the horizontal coordinate. The vertical axis at the right shows fibre mobility in relation to residence time. The presentation is hereby read in such a way that fibre mobility is read from the vertical coordinate at the right and residence time is read from the horizontal coordinate. The descriptors indicated by dashed lines are hereby read. The descriptors indicated by different marks show different constructions and thus different pressure losses. The same marks relate to the same headbox construction and thus to the same pressure loss. The maximum fibre mobility can be observed at the point where the floc size is at its minimum with each construction.

In the headbox according to the invention, fibre mobility or the fluidisation level is maintained by using the following procedures:

a) the residence time is shortened by a high pipe-specific flow rate, b) the residence time is shortened by accelerating the flow, c) the turbulence scale is diminished by reducing the channel cross-section, d) the residence time is shortened by minimising the distance from the fluidisation element to the wire.

With the aid of wedge-like lamellas 16$a_1$, 16$a_2$ acceleration of the flow is continued and thus the residence time after the automatic fluidisation unit is shortened in the headbox, and reduction of the channel cross-section (control of the scale) is continued in the lip channel part of the headbox. At the same time the share of the wall surface in the lip channel is optimised. With the aid of wall friction turbulence is brought about, which is used to slow down or even to stop the dying out of the high turbulence level brought about in the fluidiser. In addition, the achieved turbulence takes place in the lip channel divided by lamellas on the desired small scale.

In the headbox according to the invention these trouble situations are controlled with the aid of a high turbulence level, that is, fibre mobility by following the following principles:

a) Control of the scale with the aid of a small channel size reduces the size and strength of the biggest disturbance structures.

b) The high turbulence level brought about in the fluidiser efficiently breaks down coherent structures (e.g. trailing edge structures) smaller than its own scale into a stochastic turbulence. Excessive dying out of the turbulence is controlled with a short residence time, a high flow rate and the yield of boundary-layer turbulence by using lamellas and the flow surfaces of the lip channel to generate turbulence.

c) The high turbulence level quickly levels out consistency streaks from walls at the ends of turbopipes or lamellas.

d) A high Reynolds number, that is, a high pipe flow rate, and acceleration of the flow keep the boundary layers thin and stable.

e) Fluidisation is carried out efficiently only once and the said fluidised state is kept up by the means mentioned above. The disturbances caused by item c) are hereby avoided.

f) The flow is accelerated in the entire part after the fluidiser by using conical lamellas having a reducing thickness.

g) The amplitude of the coherent structures of trailing edges is kept low and the frequency high by using thin and sharp lamella tips.

Figure 3A:
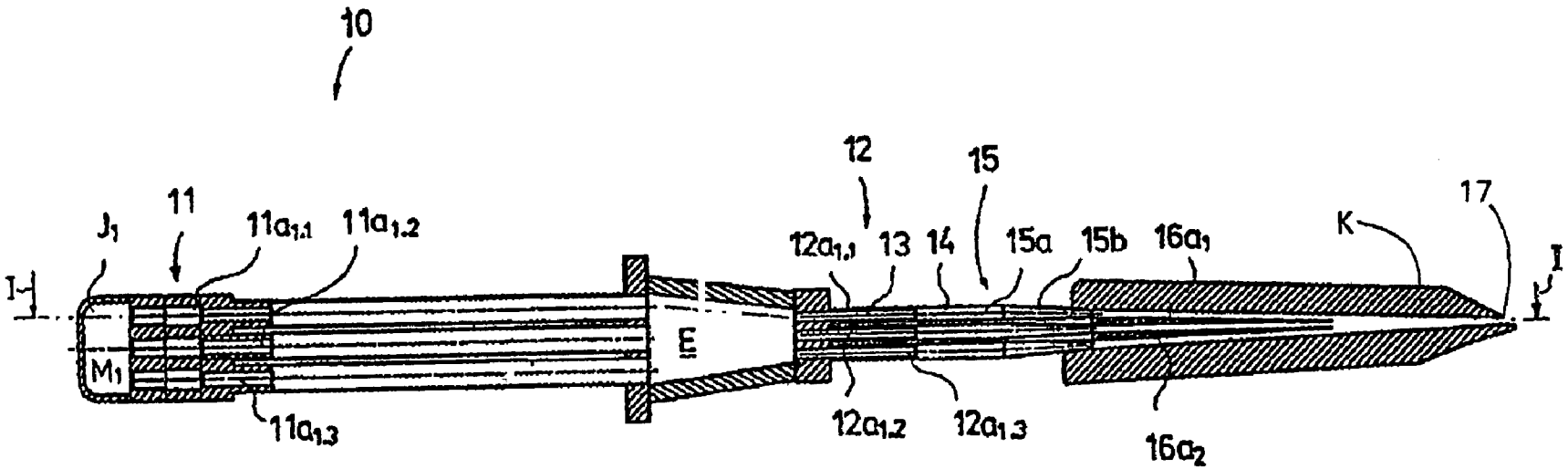
FIG. 3A is a cross-sectional view from the side of the headbox according to the invention.
Figure 4:
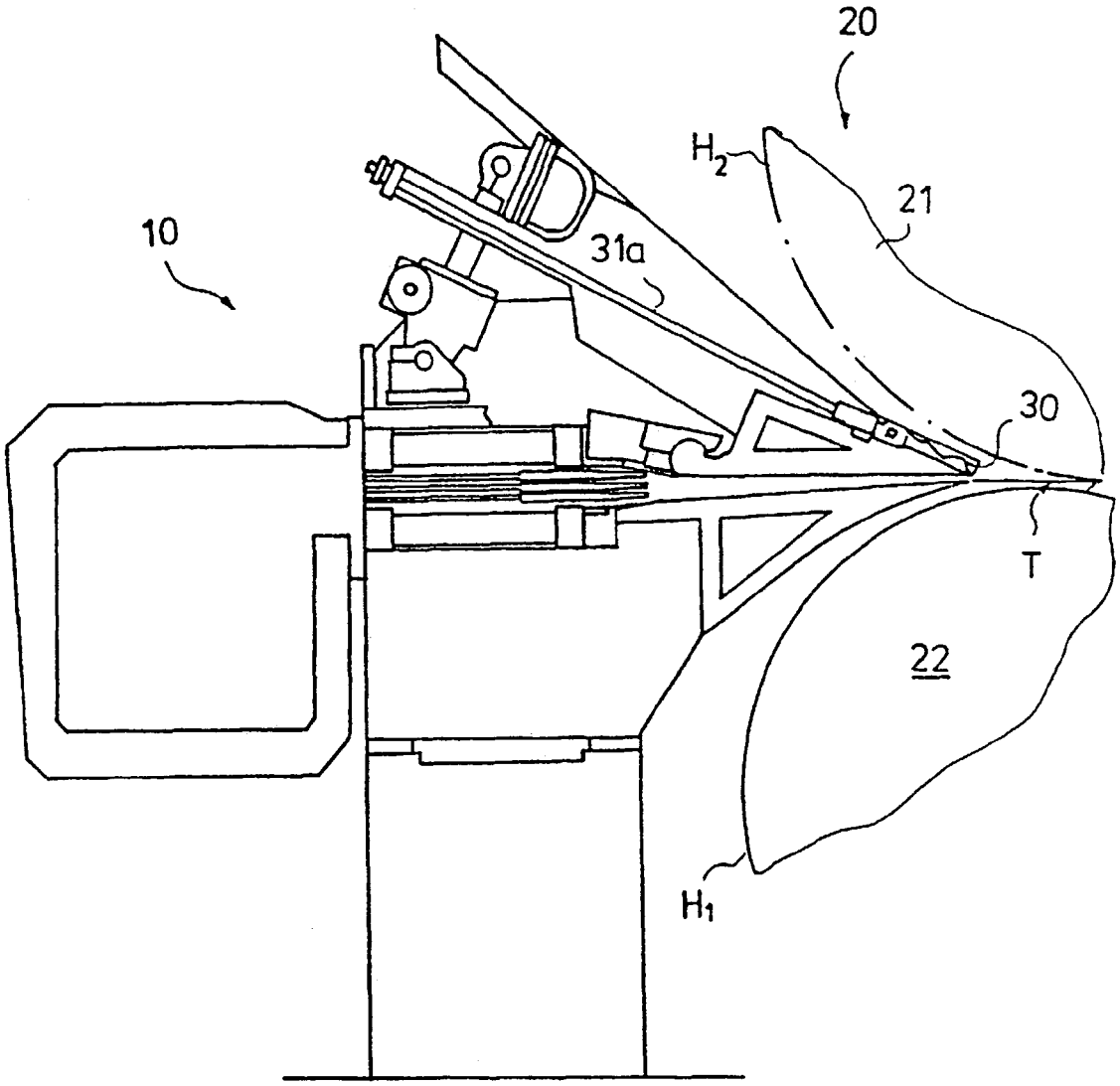
FIG. 4 shows the headbox according to the invention in connection with a jaw former.

FIG. 3A shows a side cross-sectional view of the headbox 10 according to the invention for a paper machine or a board machine or such. As is shown in FIG. 3A, pulp $M_1$ is conducted from bypass manifold $J_1$ through pipes $\mathbf{11}a_{1.1}$, $\mathbf{11}a_{1.2}$ . . . ; $\mathbf{11}a_{2.1}$, $\mathbf{11}a_{2.2}$ . . . of pipe set ii into intermediate chamber E and further into turbulence generator 12. From the turbulence generator 12 the pulp flow is guided into lip cone K, and out a lip cone discharge opening 17 and further between formation wires $H_1$ and $H_2$ into a former, preferably a jaw former 20, as shown in FIG. 4.

Figure 3B:
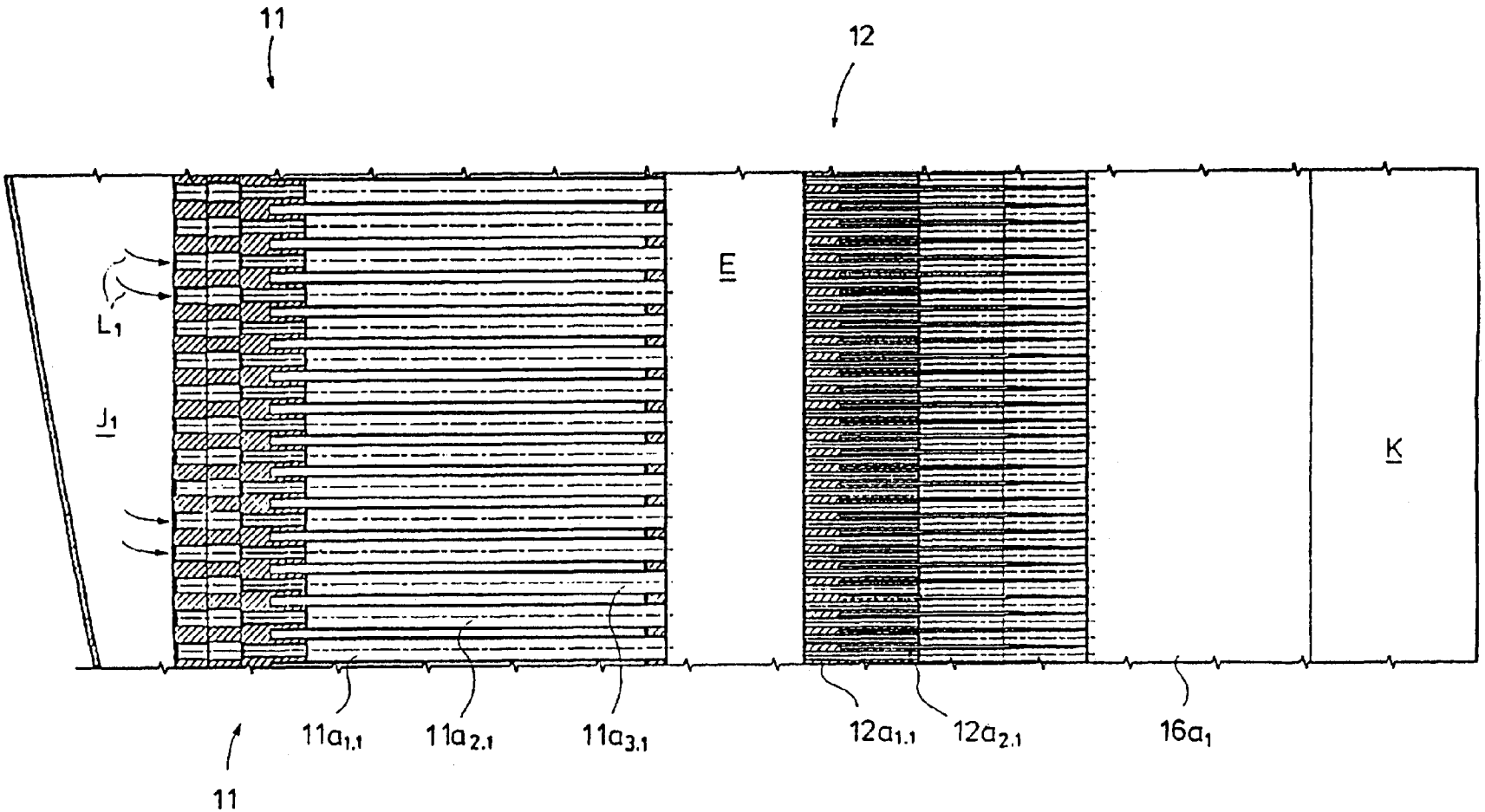
FIG. 3B is a view along sectional line I—I of the headbox according to the invention.

FIG. 3B shows s lateral cross-sectional view in accordance with FIG. 3A of headbox 10 along sectional line I—I of FIG. 3A. As is shown in FIG. 3B, a narrowing bypass manifold $J_1$ leads a pulp flow $L_1$ into pipes $\mathbf{11}a_{1.1}$, $\mathbf{11}a_{1.2}$; $\mathbf{11}a_{2.1}$, $\mathbf{11}a_{2.2}$ . . . $\mathbf{11}a_{3.1}$, $\mathbf{11}a_{3.2}$ . . . of pipe set 11 and further from the pipes of pipe set 11 into intermediate chamber E and further into turbulence generator 12 and past lamellas $\mathbf{16}a_1$, $\mathbf{16}a_2$ into lip cone K and further on to formation wire $H_1$, preferably between formation wires $H_1$ and $H_2$ of jaw former 20, as is shown in FIG. 4.

Figure 3C:
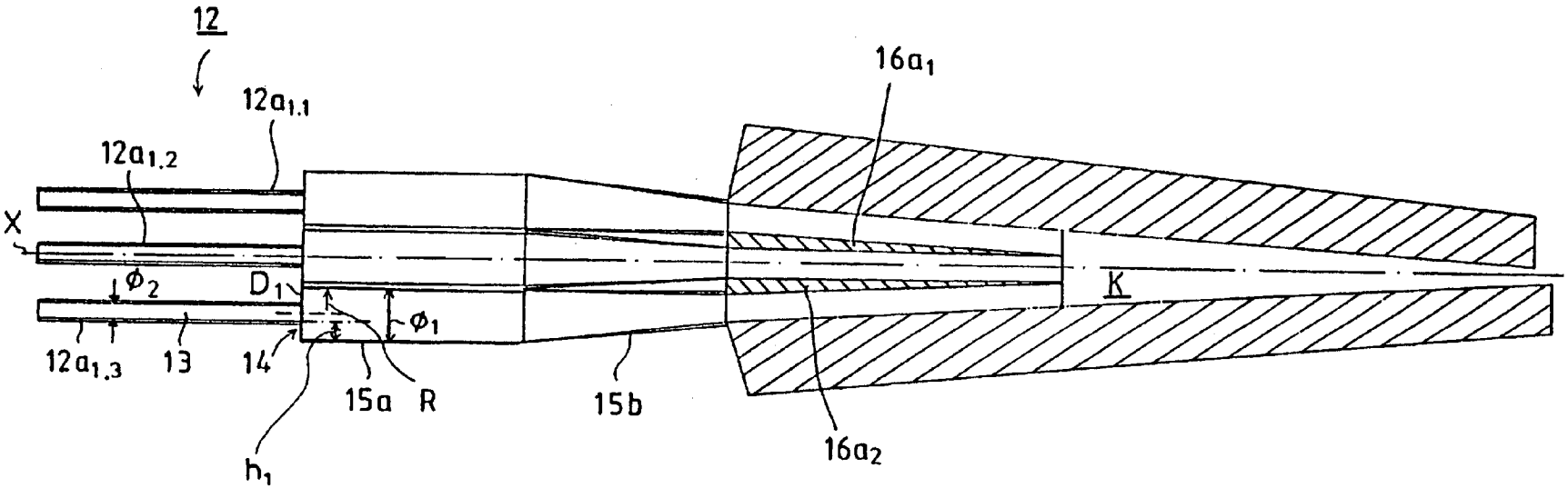
FIG. 3C is a view on a larger scale of the turbulence generator associated with the headbox according to the invention, which includes a fluidisation element according to the invention.

FIG. 3C shows on a larger scale the turbulence generator 12 and the following structures in the headbox of FIG. 3A. As is shown in FIG. 3C, the pipe $\mathbf{12}a_{1.1}$, $\mathbf{12}a_{1.2}$ . . . ; $\mathbf{12}a_{2.1}$, $\mathbf{12}a_{2.2}$ . . . of each row of pipes of the turbulence generator 12 is formed as follows. Into the intermediate chamber E narrowing in the flow direction a throttle pipe 13 opens, the length of which is at least 150 mm and inner diameter ($\Phi_2$) in the range 10 mm–20 mm. Intermediate chamber E may also have a standard cross-sectional flow area in the flow direction $L_1$. After pipe 13 in the flow direction there is a fluidiser 14, which is formed by a stepped structure with a circular cross-section, which is shown in greater detail in FIG. 6. The height h, of a step is determined by the difference between the inner diameters of mixing pipe 15*a* and throttling pipe 13, which is divided by two, that is $$h_1 = \frac{\varnothing_1 - \varnothing_2}{2}$$

and step height $h_1$ is at least equal to the average fibre length, preferably more, preferably in a range of 1 mm–12 mm, and most preferably in a range of 1 mm–6 mm. The average fibre length is typically in a range of 1 mm–3 mm, depending on the pulp used. After the fluidiser, that is, the fluidisation element 14, there is a pipe 15 of the turbulence generator, which pipe includes a rotationally symmetrical mixing pipe part 15*a* no less than 50 mm long and then an acceleration and reshaping part 15*b*, which is used to accelerate the pulp flow and the length of which is no more than 200 mm, so that the intensity of turbulence is sufficient to allow the steps in the outlet opening of pipe 15*b*. The length of lip channel K is chosen so that the flows arriving from pipes 15 have the time to mix in it, but so that re-flocculation is prevented. The length of lip channel K is chosen within a range of 100 mm–800 mm. The cross-section of pipe 15*a* turns from circular into a square in pipe 15*b*. The inner diameter $\Phi_1$ of pipe part 15*a* is in the range 20 mm–40 mm. The ratio $\Phi_1/\Phi_2$ between the inner diameters of pipes 15*a* and 13 is in the range 1.1–4.0. The flow then comes from pipe 15*b* of the turbulence generator to reach lamellas $\mathbf{16}a_1$, $\mathbf{16}a_2$ in such a way that between the pipe $\mathbf{12}a_{1.1}$, $\mathbf{12}a_{2.1}$, . . . and lamella $\mathbf{16}a_1$, $\mathbf{16}a_2$ there is no step or it is no more than 2 mm, that is, equal to the thickness of the pipe wall of the turbulence generator. According to the invention, such lamellas $\mathbf{16}a_1$, $\mathbf{16}a_2$ are used, which narrow in a wedge-like fashion in the flow direction and end in a sharp tip, the height $h_2$ of which tip is in the range 0–2 mm, preferably less than 1 mm. Thus, the headbox according to the invention in the turbulence generator includes only one fluidisation point and after this acceleration arrangements and lamella arrangements to maintain the fluidisation of the flow after the fluidisation point and to minimise the residence time in the headbox before the formation wire $H_1$, $H_2$.

After the fluidisation element 14, the pulp flow speed is accelerated essentially all the time all the way to the lip opening. After the fluidisation element 14 the maximum permissible step expansion in the flow channel in the z direction is less than the average fibre length. The minimum length of pipe 13 of the turbulence generator 12 is 150 mm, the minimum length of the rotationally symmetrical part of pipe 15*a* is 50 mm and the maximum length of pipe part 15*b* is 200 mm.

Figure 3D:
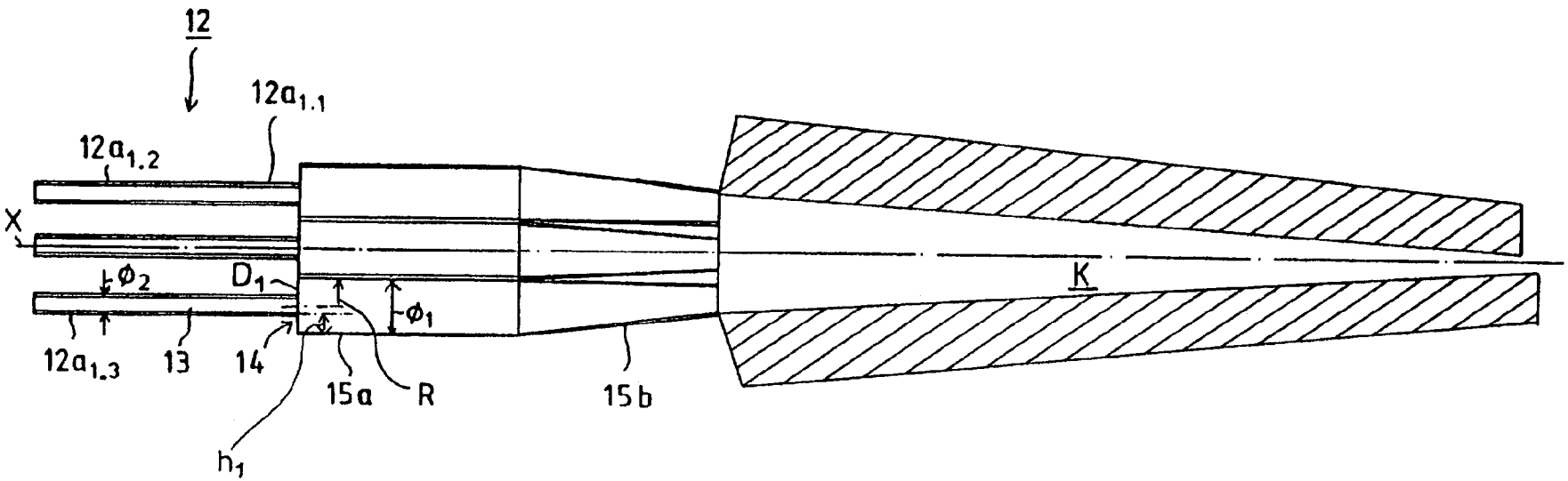
FIG. 3D shows an embodiment of the invention, wherein the fluidisation element, that is, the fluidiser, is located in the turbulence generator, which ends in the lip chamber so that the lip chamber includes no lamellas.

FIG. 3D shows an embodiment of the invention, which differs from the earlier embodiments only in that the headbox includes no lamellas. From the turbulence generator 12 the flow is guided after fluidisation directly into the lip chamber and further on to the formation wire.

FIG. 4 shows a headbox 10 according to the invention in connection with rolls 21 and 22 of former 20. The pulp discharge is conducted from headbox 10 into a jaw T in between wires $H_1$ and $H_2$. Headbox 10 includes a tip lath 30 and spindles $\mathbf{31}a_1$, $\mathbf{31}a_2$ . . . controlling it along the tip lath length at different points of the headbox width. The pulp is conducted from bypass manifold $J_1$ directly into a turbulence generator 12 according to the invention.

Figure 5:
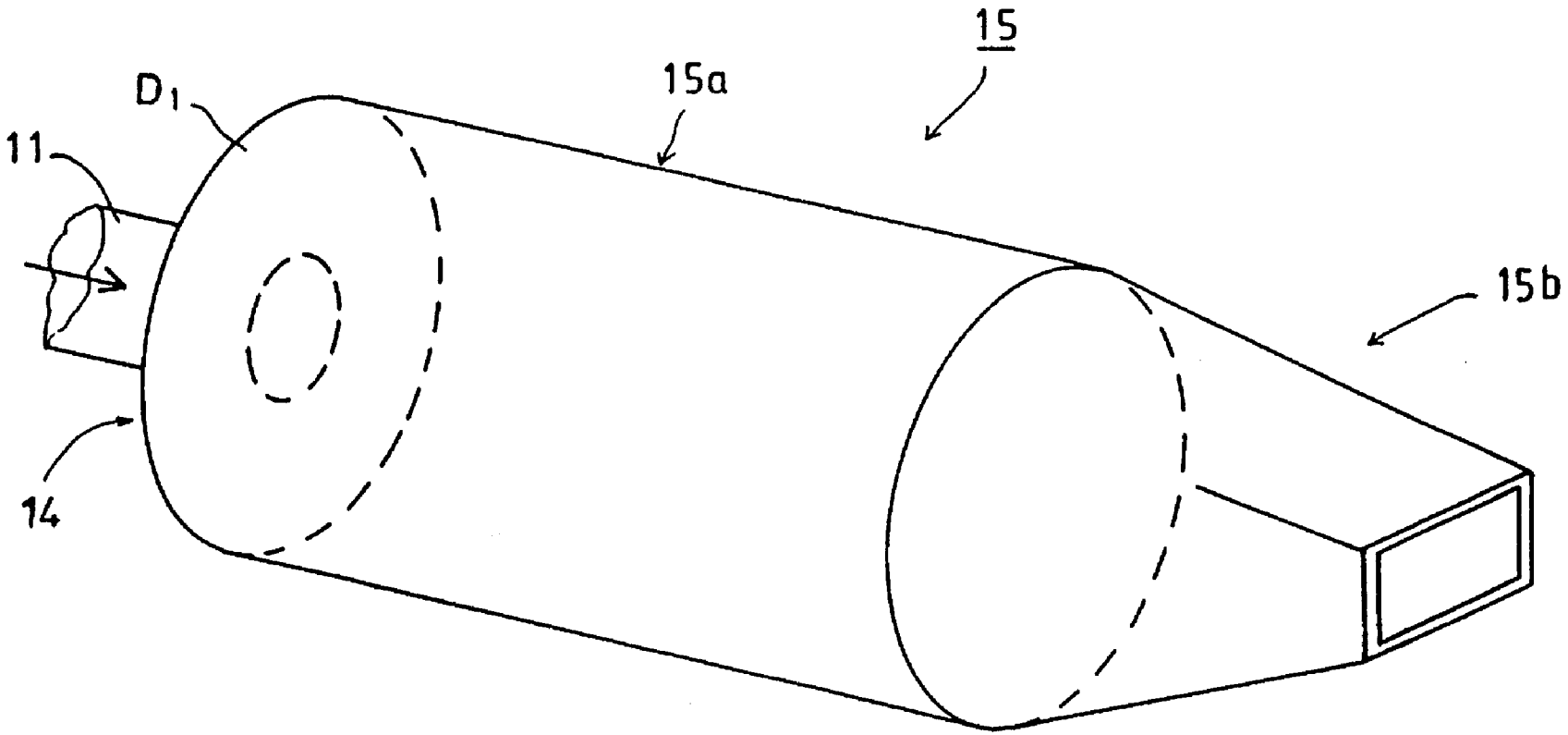
FIG. 5 shows a pipe 15 after the fluidisation element according to the invention, which pipe includes a pipe part 15*a* with a circular cross-section, and next a pipe part 15*b* turning into a rectangular cross-section.

FIG. 5 shows in a headbox according to the invention a turbulence pipe 15 used in its turbulence generator 12, which pipe includes a pipe part 15*a* with a circular cross-section, which ends in a rectangular cross-section 15*b*. The wall thickness is approximately 2 mm. In the circular cross-section the degree of fluidisation is developed to its maximum, and thereafter the flow is accelerated in the pipe part 15*b* in order to minimise the residence time in the headbox. The said pipe part 15*b* is also a so-called reshaping part, wherein the circular cross-section turns into a rectangular cross-section, which is the most advantageous end shape for the pipes of the turbulence generator. As is shown in the figure, a lamella $\mathbf{16}a_1$ narrowing in a wedge-like fashion is located in between the pipe rows $\mathbf{12}a_{1.1}$ and $\mathbf{12}a_{1.2}$ of the turbulence generator, and a second lamella $\mathbf{16}a_2$ narrowing in a wedge-like fashion into lip cone K is located in between the pipe rows $\mathbf{12}a_{1.2}$ and $\mathbf{12}a_{1.3}$ of the turbulence generator.

Figure 6:
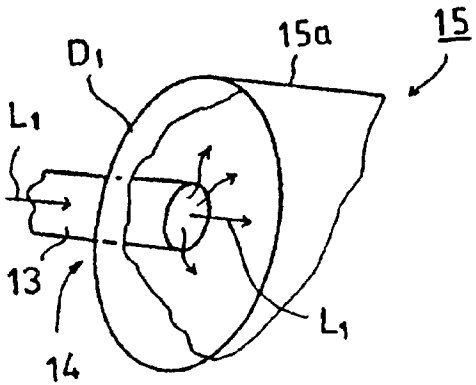
FIG. 6 is an axonometric view of the fluidiser, that is, the fluidisation element, according to the invention.

FIG. 6 shows the fluidisation element 14 or fluidiser according to the invention, which is formed by a pipe expansion. According to the invention, the fluidisation element as shown in the figure after the pipe part 13 includes a channel expansion, that is, a step, which includes a wall structure $D_1$, preferably an annular plate, whose plane is at right angles to the longitudinal axis X of pipe 11 and to the flow direction $L_1$ and which annular wall part $D_1$ ends in the inner wall of pipe 15*a*, which has a circular cross-section. The height $h_1$ of the step expansion of fluidisation element 14 is in the range 1–12 mm and at least equal to the average fibre length. In the fluidiser shown in FIG. 6, the pulp flow $L_1$ is thus conducted from pipe 13 to a radially expanding point including the annular wall structure $D_1$, which ends in the inner surface of pipe 15*a*, which has a circular cross-section. Under these circumstances, the radially travelling flow is limited by the wall structure $D_1$ and by the pipe's 15*a* inner wall surface, which has a circular cross-section.

Figure 7:
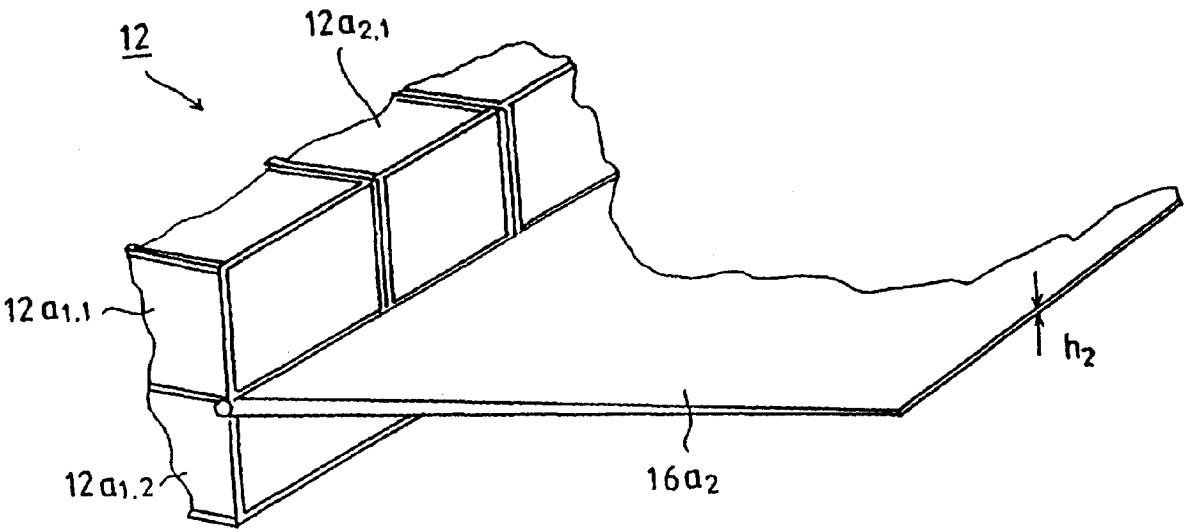
FIG. 7 shows how the lamella is joined to the turbulence generator.

FIG. 7 shows the structure of the lamella according to the invention and how it joins the end face of the outlet end of turbulence generator 12. As can be seen in the figure, the lamella narrows in a wedge-like fashion and it ends in a sharp tip 16*b*, the maximum height of which is 2 mm. Preferably there is no step between the lamella $\mathbf{16}a_1$, $\mathbf{16}a_2$ and the end face of the turbulence generator's pipe. If a step occurs, it is no more than 2 mm, that is, of the wall thickness of the turbulence generator's pipe.

Figure 8:
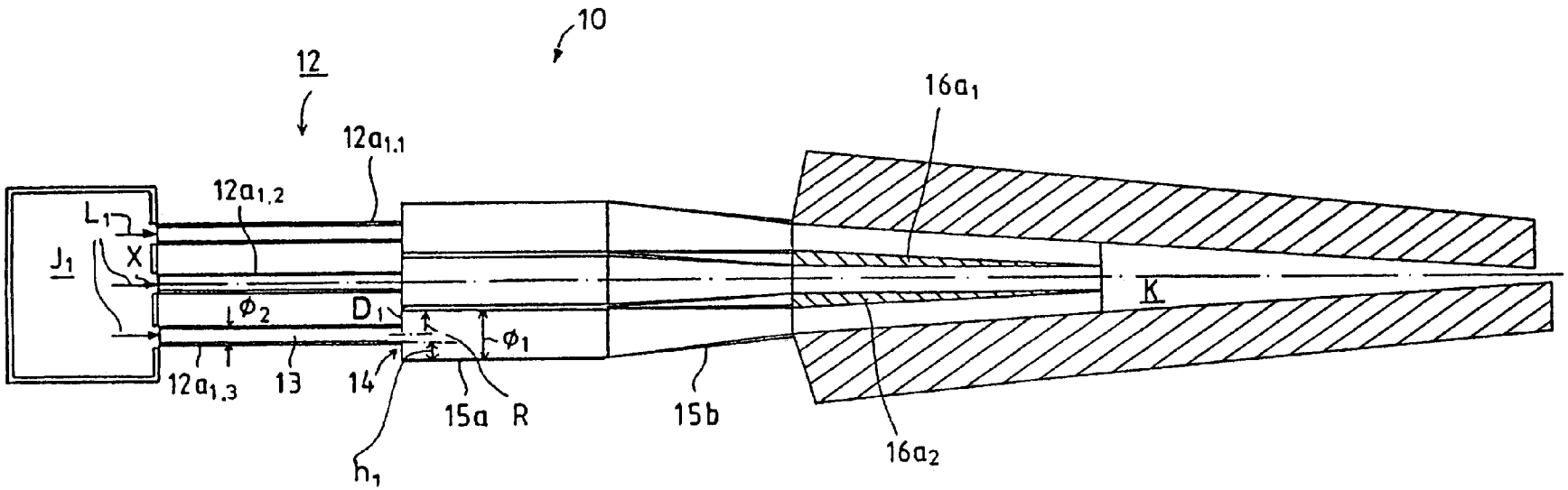
FIG. 8 shows an embodiment of the headbox according to the invention, wherein the pulp is guided from the bypass manifold directly into the turbulence generator according to the invention.

FIG. 8 shows an embodiment of the invention, wherein the headbox of the paper machine includes a bypass manifold $J_1$ and after the bypass manifold a turbulence generator 12 according to the invention. Thus, pulp $M_1$ is conducted as arrows $L_1$ show directly into turbulence generator 12, into the pipes $\mathbf{12}a_{1.1}$, $\mathbf{12}a_{1.2}$ . . . ; $\mathbf{12}a_{2.1}$, $\mathbf{12}a_{2.2}$ . . . of its pipe rows. The turbulence generator 12 includes a structure similar to the one shown in the embodiment of FIGS. 3A, 3B and 3C. Thus, the pulp is conducted into such pipes $\mathbf{12}a_{1.1}$, $\mathbf{12}a_{1.2}$ . . . ; $\mathbf{12}a_{2.1}$, $\mathbf{12}a_{2.2}$ . . . of the turbulence generator's pipe rows, where each pipe includes one fluidisation element or fluidiser 14. The pulp is conducted from bypass manifold $J_1$ first into pipe 11 and then through the radial expansion, that is, the fluidiser, into the pipe 15*a* with a bigger diameter, which includes a part 15*a* having a circular cross-section, which in part 15*b* turns into a narrowing rectangular cross-section. Part 15*b* is the pulp acceleration part, from which the pulp is conducted further into lip chamber K, which includes lamellas $\mathbf{16}a_1$, $\mathbf{16}a_2$, which at their surfaces join the plane of the turbulence generator's end pipes essentially without a step. Thus, after the fluidisation point as little disturbances as possible occur in the flow after the fluidisation point, and the flow is accelerated, so that the residence time of the pulp in the headbox is as short as possible and the pulp is brought with a good fluidisation degree on to the formation wire or formation wires.

The headbox according to the invention may be used not only in a paper machine but also in board machines, soft tissue machines and pulp drying machines.

The invention claimed is:

1. A headbox of a papermaking machine comprising:

a pulp flow manifold;

a lip cone having a lip discharge opening through which stock flows to a former;

wherein a pulp flow direction is defined from the pulp flow manifold to the lip opening;

a turbulence generator extending between the pulp flow manifold and the lip cone, the turbulence generator comprised of a plurality of first pipes each having a first inside diameter, each first pipe terminating in a fluidization element step comprising an annular wall structure, which extends to an inner flow surface of a second pipe which has a circular cross-section, the second pipe being coaxial with the first pipe, and the second pipe inner flow surface having an inside diameter which is greater than the first inside diameter, the second pipes having outlet ends leading into the lip cone, each second pipe defining an interior flow surface;

lamellas positioned in the lip cone, and joined at their inlet ends to the outlet ends of the turbulence generator second pipes;

wherein between the turbulence generator, and the lip discharge opening, there exists no vertical step which is more than approximately 2 mm.

2. The headbox of claim 1 wherein flow is stepless along the interior flow surfaces of the second pipes on to surfaces defined by the lamellas.

3. The headbox of claim 1 further comprising lamellas positioned in the lip cone, and joined at their inlet ends to the outlet ends of the turbulence generator second pipes, wherein flow along the interior flow surfaces of the second pipes on to surfaces defined by the lamellas has a step of no more than the pipe thickness of the second pipes at the outlet ends.

4. The headbox of claim 3 wherein the lamellas narrow as the lamellas extend toward the lip opening.

5. The headbox of claim 3 wherein the lamellas narrow in a wedge-like fashion as the lamellas extend toward the lip opening, the lamellas having downstream ends which have a thickness in a range of 0–2 mm.

6. The headbox of claim 1 wherein each first pipe fluidization element step has a height defined as the inside diameter of the inner surface of the second pipe minus the first inside diameter divided by two, and the height of said fluidization element step is in the range 1 mm–12 mm.

7. The headbox of claim 1 wherein the ratio between the inner diameter of the first pipe and the inner diameter of the second pipe is in a range of 1.1 to 4.0.

8. The headbox of claim 1 wherein the second pipe has a first section connected to a second section, and a cross-sectional area is defined at each point in the headbox between the second pipe first section and the lip opening of the lip cone, and wherein the cross-sectional area continuously decreases as the lip opening is approached so that the pulp flow accelerates essentially all the time all the way to lip opening.

9. The headbox of claim 1 wherein after the fluidization element in the flow channel, any step expansion in the z direction is smaller than a value between 1 and 3 mm.

10. The headbox of claim 1 wherein the second pipe has a first part which includes the circular cross-section and a second part of rectangular cross-section joining the first part, and wherein the second part narrows in the flow direction so pulp flow is accelerated as it flows through the second pipe.

11. The headbox of claim 10 wherein the length of the first pipes is at least 150 mm, and the length of the first parts of the second pipes is at least 50 mm and the length of the second parts of the second pipes is no more than 200 mm.

12. The headbox of claim 1 wherein a cross-sectional area is defined at each point in the headbox between the fluidization element and the lip opening of the lip cone, and wherein the cross-sectional area continuously decreases as the lip opening is approached so that the pulp flow accelerates essentially all the time all the way from the fluidization element to the lip opening.

13. A headbox of a papermaking machine comprising:

a pulp flow manifold;

a lip cone having a length of between 100 mm and 800 mm and having a lip discharge opening through which stock flows to a former, wherein a pulp flow direction is defined from the pulp flow manifold to the lip discharge opening;

a turbulence generator extending between the pulp flow manifold and the lip cone, the turbulence generator comprised of a plurality of first pipes, having first inside diameters between 10 mm–20 mm, each first pipe terminating in a fluidization element step comprising an annular wall structure, which extends to an inner surface of a second pipe which has a circular cross-section, the second pipe being coaxial with the first pipe and the second pipe having an inside diameter of the inner surface which is between 20 mm and 40 mm and which is greater than the first inside diameter, the second pipes having outlet ends leading into the lip cone, each second pipe defining an interior flow surface;

wherein the fluidization element step has a height defined as the inside diameter of the inner surface of the second pipe minus the first inside diameter divided by two, and wherein the height of the fluidization element step is in the range of 1 mm–12 mm;

wherein the second pipe has a first part which has the circular cross-section and a second part of rectangular cross-section joining the first part, and the second part narrows in the flow direction so pulp flow is accelerated as it flows through the second pipe;

wherein a cross-sectional area is defined at each point in the headbox between the turbulence generator and the lip discharge opening of the lip cone, and wherein the cross-sectional area continuously decreases as the lip discharge opening is approached so that the pulp flow accelerates essentially all the time all the way from the turbulence generator to the lip discharge opening;

wherein the length of the first pipes is at least 150 mm, and the length of the first part of the second pipes is at least 50 mm and the length of the second part of the second pipes is no more than 200 mm;

lamellas joined at their inlet ends to the outlet ends of the turbulence generator second pipes, the lamellas positioned in the lip cone, wherein flow along the interior flow surfaces of the second pipes on to surfaces defined by the lamellas has a step of no more than the pipe thickness of the second pipes at the outlet ends, said pipe thickness being approximately 2 mm;

wherein the lamellas narrow in a wedge-like fashion as the lamellas extend toward the lip discharge opening, the lamellas having downstream ends which have a thickness in a range of 0–2 mm; and wherein between the turbulence generator, and the lip discharge opening, there is no vertical step which is more than approximately 2 mm.

14. The headbox of claim 13 wherein between the turbulence generator, and the lip opening, no vertical step is present.

* * * * *